US005964196A

United States Patent [19]

Sigle et al.

[11] Patent Number: 5,964,196

[45] Date of Patent: Oct. 12, 1999

[54] CYLINDER HEAD FOR A MULTI-CYLINDER INTERNAL COMBUSTION ENGINE

[75] Inventors: Bernd Sigle, Weinstadt; Christoph Spengel, Grossbettlingen, both of Germany

[73] Assignee: DaimlerChrysler A.G., Stuttgart, Germany

[21] Appl. No.: 08/957,681

[22] Filed: Oct. 24, 1997

[51] Int. Cl.[6] ..... F02F 1/38

[52] U.S. Cl. ..... 123/193.5

[58] Field of Search ..... 123/193.5, 41.82 R, 123/193.1

[56] References Cited

U.S. PATENT DOCUMENTS

| | | | |
|---|---|---|---|
| 4,530,323 | 7/1985 | Wakasa | 123/41.82 R |
| 4,641,609 | 2/1987 | Tanaka | 123/193.5 |
| 4,889,079 | 12/1989 | Takeda et al. | 123/193.5 |

FOREIGN PATENT DOCUMENTS 35 13 126 10/1986 Germany .

*Primary Examiner*—Marguerite McMahon
*Attorney, Agent, or Firm*—Klaus J. Bach

[57] ABSTRACT

In a cylinder head for a multi-cylinder internal combustion engine, wherein the cylinder head includes between its bottom top and side walls a cooling water space through which intake and exhaust passages extend and also columns with bores for receiving cylinder head mounting bolts and well structures for receiving spark plugs or fuel injectors and the bottom wall delineates at its lower side a combustion chamber for each cylinder, wall structures are cast onto the top side of the cylinder head bottom wall and extend in the circumferential area of each combustion chamber in transverse and longitudinal directions between adjacent columns with which they are integrally formed and at least the transverse wall structures extend upwardly and join the top wall and the intake and exhaust passages extend through, and are joined to, the longitudinal wall structures.

5 Claims, 4 Drawing Sheets

CYLINDER HEAD FOR A MULTI-CYLINDER INTERNAL COMBUSTION ENGINE

BACKGROUND OF THE INVENTION

The invention relates to cast a cylinder head of a multi-cylinder internal combustion engine including a cooling water space delimited by cylinder head bottom-top-and sidewalls. Intake and exhaust passages extend through the cooling water space. Also wells for receiving spark plugs or injectors extend through the cooling water space and are connected to the bottom and top walls of the cylinderhead.

Modern internal combustion engines, particularly highly charged Diesel engines with direct fuel injection are subjected to high peak combustion pressures which requires the cylinder head to have a high rigidity. With insufficient rigidity high vibration amplitudes can occur in the center area of the combustion chambers, which can lead to the formation of cracks in the cylinder head bottom wall and/or in other parts of the cylinder head. In addition, deformations of the valve guides and the valve seals may occur which may result in valve breakages or at least in valve leaks with subsequent thermal overloading of the valves, the valve seat rings and the valve guides.

A cast cylinder head of this type (see for example, DE-A 35 13 126) includes a water space delimited by the cylinder head bottom- top- and sidewalls. Intake and exhaust passages and wells for receiving spark plugs or injectors extend through the cooling water space. To increase the rigidity of the areas of the cylinder head bottom wall in the vicinity of the combustion chambers, the arrangement as shown in DE-A 35 13 126 includes within the cooling water space support walls which extend between the cylinder head bottom and top walls. The support walls have incorporated therein support columns for bores receiving the cylinder head bolts. In addition, there is provided a longitudinal rib, which extends between the cylinder head bottom and top walls over the length of the cylinder head and which is interconnected with the support walls and the wells for the spark plugs or the injectors. In this way, the rigidity of the cylinder head is substantially increased, but this is still not sufficient to accommodate the extremely high peak pressures of Diesel engines with direct fuel injection.

It is therefore the principal object of the present invention to provide a cylinder head with further increased rigidity.

SUMMARY OF THE INVENTION

In a cylinder head for a multi-cylinder internal combustion engine, wherein the cylinder head includes between its bottom top and side walls a cooling water space through which intake and exhaust passages extend and also columns with bores for receiving cylinder head mounting bolts and well structures for receiving spark plugs or fuel injectors, and the bottom wall has at its lower side a combustion chamber for each cylinder, wall structures are cast onto the top side of the cylinder head bottom wall and extend in transverse and longitudinal directions between adjacent columns with which they are integrally cast and at least the transverse wall structures extend upwardly and join the top wall and the intake and exhaust passages extend through and are joined to the longitudinal wall structures.

In the cylinder head according to the invention, a high rigidity is achieved by the longitudinal and transverse walls cast onto the bolt receiving column, which are disposed around the combustion chambers. This rigidity is still further increased by transverse walls extending in the vicinity of the combustion chamber between the bottom and top walls of the cylinder head between adjacent bolt mounting columns. Preferably, support is also provided by the longitudinal walls through which the intake and exhaust passages extend, by way of webs which extend from the top edges thereof up to the cylinder head top wall. In a four valve cylinder head, webs extend from the top edge of the respective longitudinal walls at areas which are between the two exhaust passages and the two intake passages of each cylinder up to the top wall of the cylinder head. In a Diesel engine bores are provided in the webs between the intake passages for receiving glow plugs.

An embodiment of the invention will be described below on the basis of the accompanying drawings.

BRIEF DESCRIPTIONS OF THE DRAWINGS

FIG. 1 is a top view of a cylinder head of a four cylinder Diesel engine with four valves per cylinder head and direct fuel injection, FIG. 2 is a sectional view taken along line A—A of FIG. 1, FIG. 3 is a sectional view taken along line B—B of FIG. 1, FIG. 4 is a sectional view taken along line C—C of FIG. 1, FIG. 5 is a sectional view taken along line D—D of FIG. 1, and FIG. 6 is a sectional view taken along line E—E of FIG. 5.

DESCRIPTION OF A PREFERRED EMBODIMENT

Figure 1:
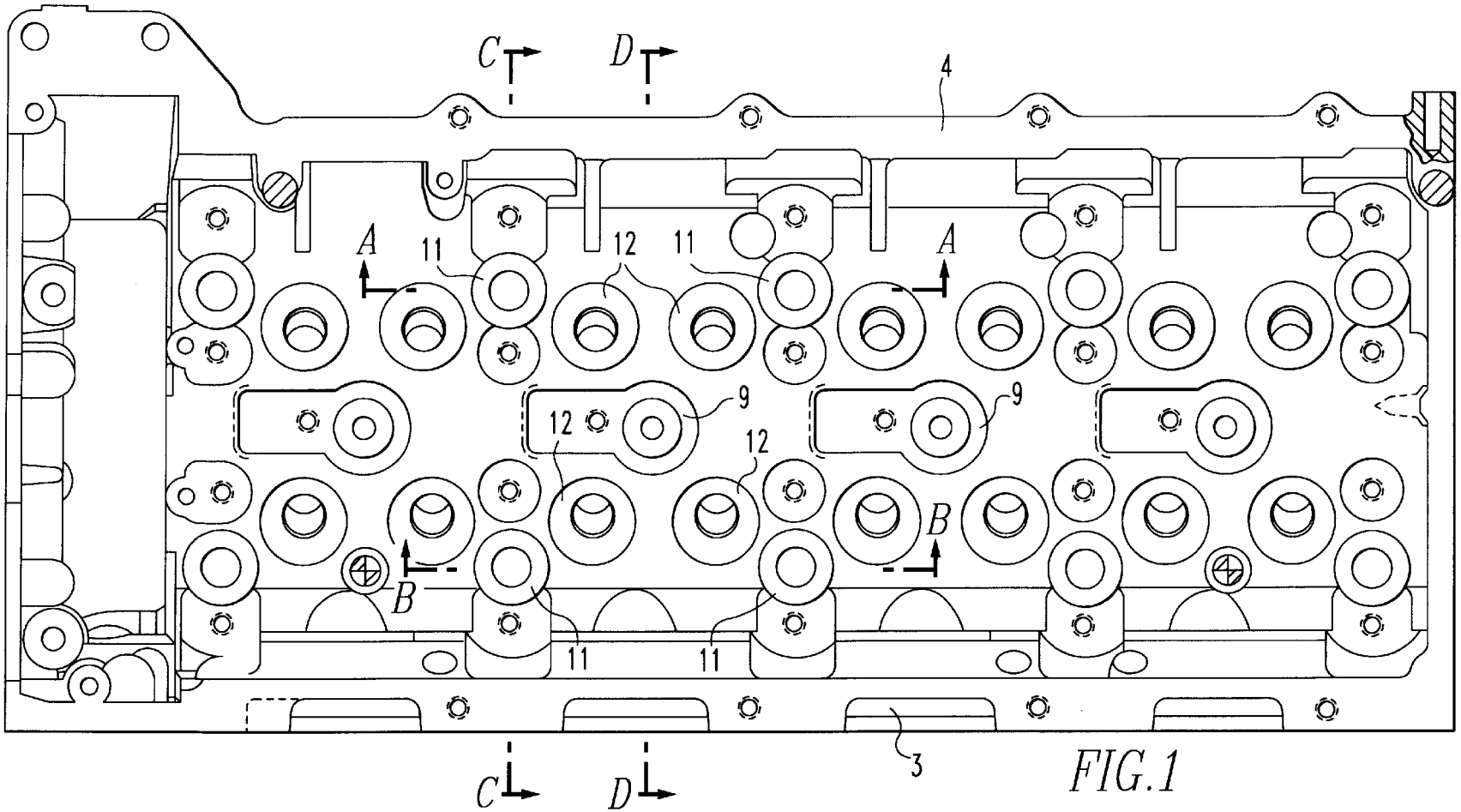

FIG. 1 shows a cast cylinder head, which comprises a bottom wall 1 a strong top wall 2 and outer side walls 3 and 4, which together delimit a water space 5. The underside of the bottom wall 1 delineates for each cylinder a combustion chamber 6 (FIG. 6) with two intake passages 7 and two exhaust passages 8, which extend through the cooling water space to the side walls 3 and, respectively, 4. Furthermore, there is provided for each combustion chamber a well 9 extending centrally above the combustion chamber for receiving an injector, which extends from the bottom wall 1 up to the top wall 2 and beyond through the adjacent valve control space 10. For receiving the cylinder head bolts, there are provided around each combustion chamber 6 four vertical hollow columns 11, which extend from the bottom wall 1 up to the top wall 2. The numeral 12 indicates the valve guides for the intake and exhaust valves which are not shown.

Figure 2:
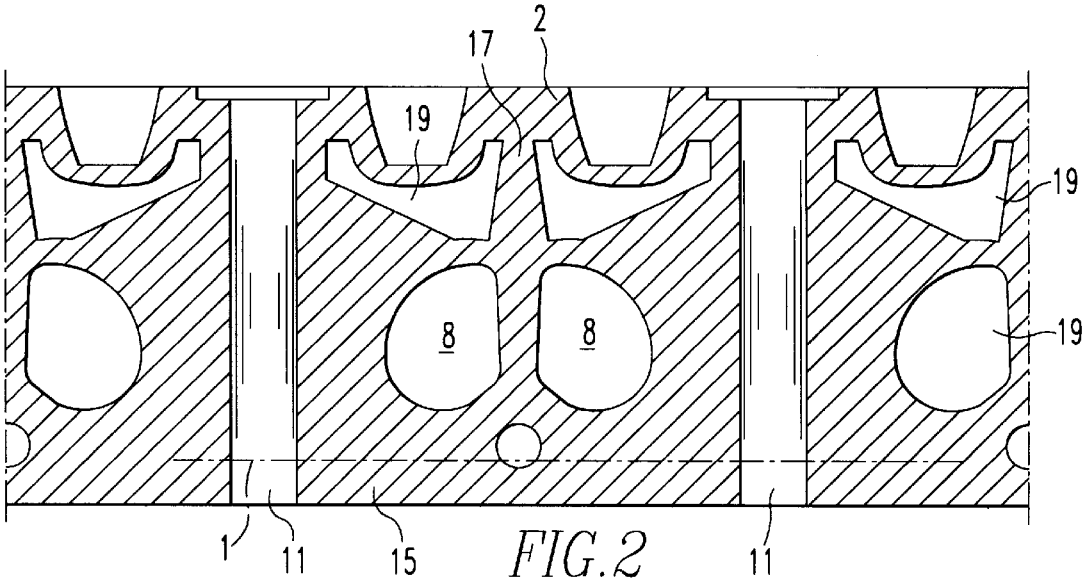
Figure 3:
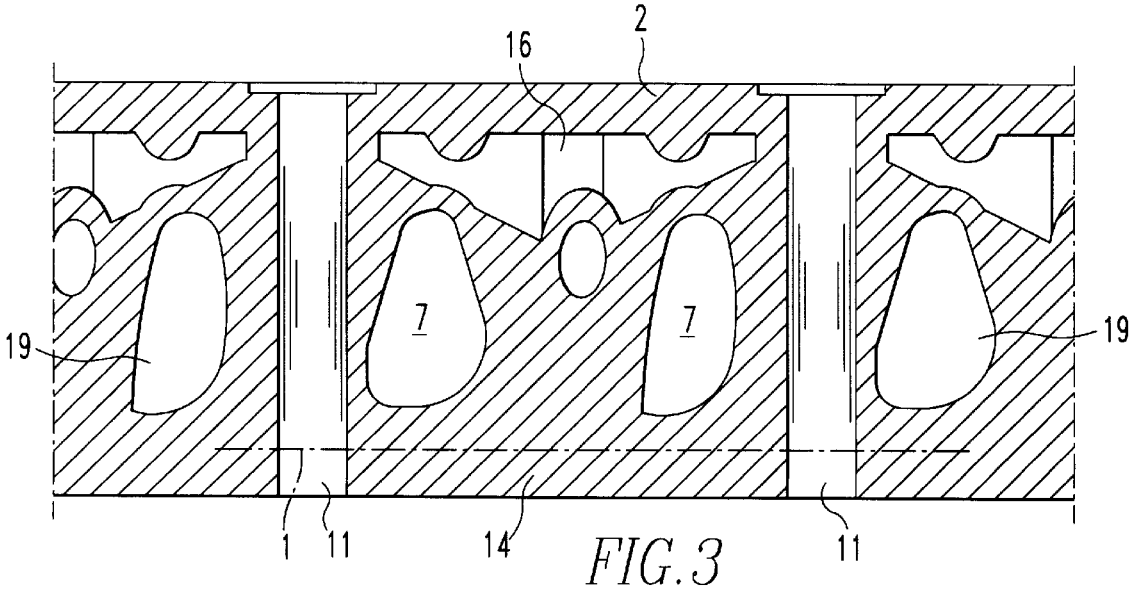
Figure 4:
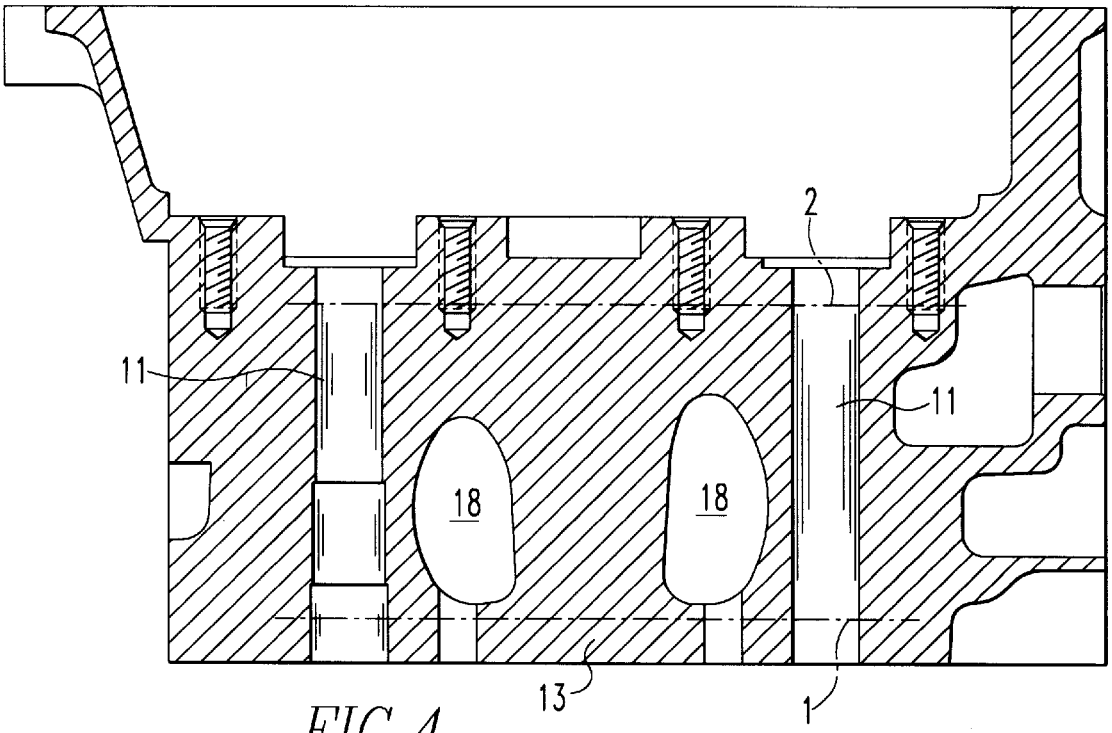
Figure 5:
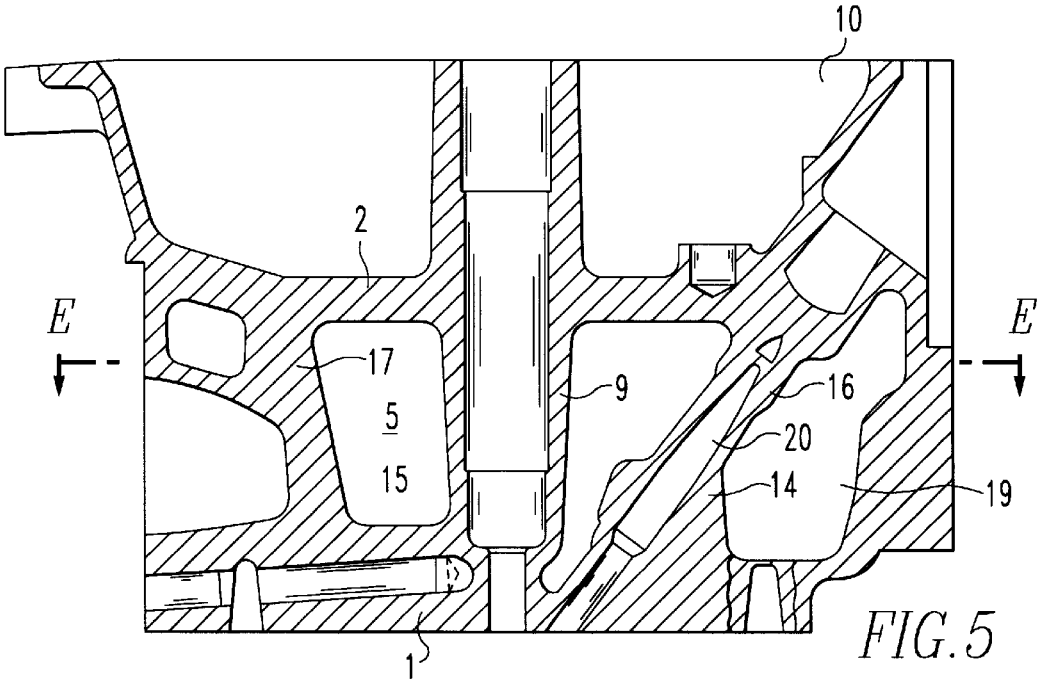
Figure 6:
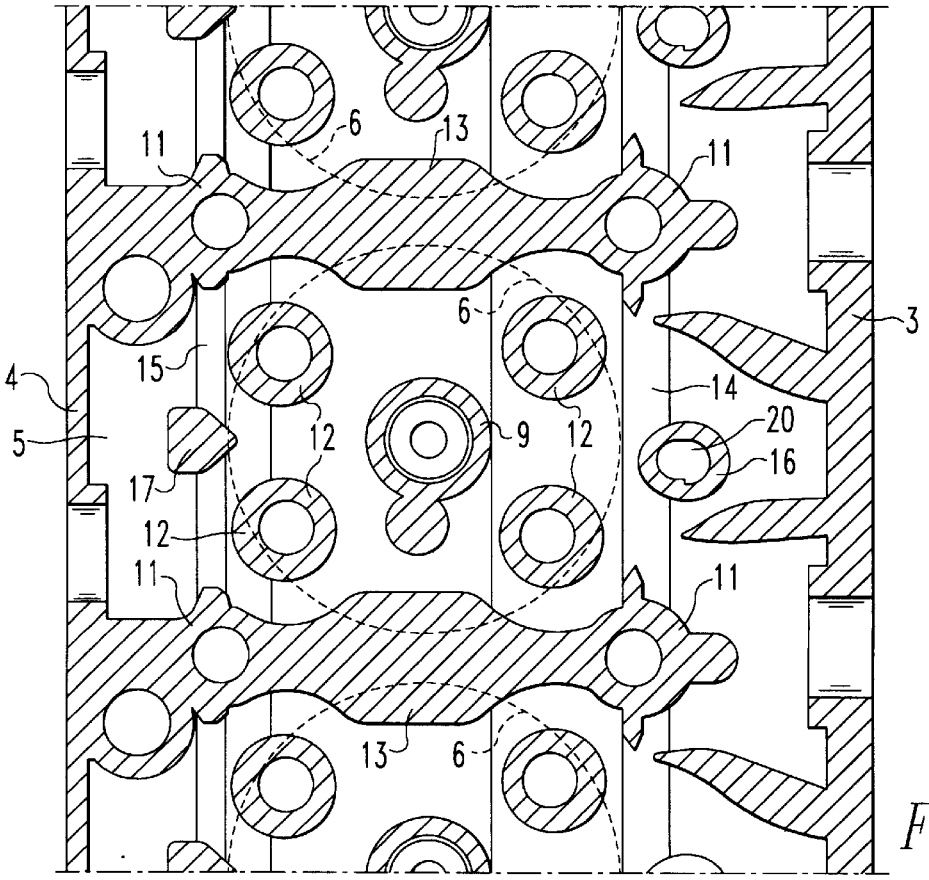

In order to achieve high rigidity for the cylinder head bottom 1, particularly along the circumference of a combustion chamber 6, adjacent bolt columns 11 are interconnected by vertical cast transverse walls 13 extending between adjacent combustion chambers, and adjacent bolt columns 11 disposed alongside the outer side walls 3, 4 are interconnected by cast-on longitudinally extending vertical wall structures 14 and, respectively, 15. As shown in FIG. 4, the transverse walls 13 extend directly from the bottom wall 1 up to the top wall 2 and are as shown in FIG. 6 strengthened in their center portion so that they project into the projection area of the adjacent combustion chamber 6. The intake passages 7 extend through the longitudinal wall 14, the walls of the intake passages 7 being cast integrally with the longitudinal wall 14 (FIG. 3). In the same way the exhaust passages 8 extend through the longitudinal wall 15 (FIG. 2). The walls of the intake and exhaust passages are also cast onto the well structure 9. The longitudinal walls 14 and 15 extend at their ends where they join the bolt mounting columns 11 up to the top wall 2, that is, up to the vicinity of the areas in which the bolt mounting forces are effective on the cylinder head. They are integral with the top wall 2 so that the bolt forces are evenly distributed over the circumference of each combustion chamber 6. As shown in FIGS. 5 and 6, the longitudinal walls 14, 15 have also increased wall thicknesses in the areas adjacent the bottom wall 1 of the cylinder head so that they too extend into the projection area of the combustion chamber 6. In addition, the longitudinal walls 14, 15 are supported at their centers on the top wall 2 by means of web structures 16 and, respectively, 17. In the four valve cylinder head as shown, the webs 16, 17 are consequently disposed between the two intake and exhaust passages as shown in FIGS. 2 and 3. The cylinder head bottom wall is supported by way of the transverse walls 13 and the longitudinal walls 14, 15 and respectively, the web structures 16, 17 on the strong cylinder head cover 2 over most of the circumference of each combustion chamber 6.

The transverse walls 13 include openings 18 for the conduction of cooling water. Additional openings or hollow spaces for cooling water are designated by the numeral 19. The web 16 extending from the longitudinal wall 14 includes a longitudinal bore 20 for receiving a glow plug.

What is claimed is:

1. A cylinder head for a multi-cylinder internal combustion engine, said cylinder head consisting of a casting with bottom top and side walls defining therebetween a cooling water space and having intake and exhaust passages extending through said cooling water space, columns extending between said bottom and top walls and having bores for receiving cylinder head mounting bolts and well structures also extending between said bottom and top walls for receiving spark plugs or injectors, said bottom wall delineating at its lower side for each cylinder a combustion chamber, and wall structures cast onto the top side of said bottom wall at the circumference of each combustion chamber and extending in transverse and longitudinal directions of the cylinder head between adjacent columns with which said wall structures are integrally formed, at least said transverse wall structure extending upwardly up to, and joining, said top wall, and said intake and exhaust passages passing through said longitudinally extending wall structures and being integrally formed therewith.

2. A cylinder head according to claim 1, wherein said longitudinal wall structures extend in the areas where they join said bolt receiving columns up to said cylinder head wall.

3. A cylinder head according to claim 2, wherein webs extend from the center area of top edges of said longitudinal wall structures up to the top wall of the cylinderhead.

4. A cylinder head according to claim 3, wherein, in an engine with four valves for each cylinder, said webs extend from areas between the two intake and exhaust passages of each combustion chamber and all extend up to the cylinder head top wall.

5. A cylinder head according to claim 4, wherein bores for the reception of glow plugs are disposed in the webs which extend from an area between said intake passages.

* * * * *